US009449592B2

(12) United States Patent
Dedene

(10) Patent No.: US 9,449,592 B2
(45) Date of Patent: Sep. 20, 2016

(54) MUFFLER SHELL FOR USE IN THE EXHAUST SYSTEM OF A VEHICLE

(71) Applicant: Scambia Holdings Cyprus Limited, Limassol (CY)

(72) Inventor: Luk Dedene, Heusden-Zolder (BE)

(73) Assignee: Bosal Emission Control Systems N.V., Lummen (BE)

( * ) Notice: Subject to any disclaimer, the term of this patent is extended or adjusted under 35 U.S.C. 154(b) by 17 days.

(21) Appl. No.: 14/480,859

(22) Filed: Sep. 9, 2014

(65) Prior Publication Data

US 2015/0068835 A1 Mar. 12, 2015

(30) Foreign Application Priority Data

Sep. 9, 2013 (EP) ..... 13183508

(51) Int. Cl.

| | |
|---|---|
| ***F01N 1/10*** | (2006.01) |
| ***G10K 11/16*** | (2006.01) |
| ***F01N 13/14*** | (2010.01) |
| ***F01N 13/16*** | (2010.01) |
| ***F01N 1/24*** | (2006.01) |
| ***F01N 13/00*** | (2010.01) |

(52) U.S. Cl.

CPC ..... *G10K 11/161* (2013.01); *F01N 1/10* (2013.01); *F01N 1/24* (2013.01); *F01N 13/008* (2013.01); *F01N 13/14* (2013.01); *F01N 13/141* (2013.01); *F01N 13/146* (2013.01); *F01N 13/16* (2013.01); *F01N 2310/00* (2013.01); *F01N 2470/06* (2013.01); *F01N 2470/12* (2013.01); *F01N 2470/20* (2013.01); *F01N 2510/04* (2013.01); *F01N 2530/00* (2013.01); *F01N 2530/04* (2013.01); *F01N 2530/26* (2013.01)

(58) Field of Classification Search

CPC ..... F01N 1/10
USPC ..... 181/256, 228, 282
See application file for complete search history.

(56) References Cited

U.S. PATENT DOCUMENTS

| | | | | |
|---|---|---|---|---|
| 3,108,924 | A * | 10/1963 | Adie | 428/158 |
| 3,283,847 | A * | 11/1966 | Lentz et al. | 181/245 |
| 3,400,784 | A * | 9/1968 | Thrasher | 181/267 |

(Continued)

FOREIGN PATENT DOCUMENTS

| | | | |
|---|---|---|---|
| CN | 202338373 | U | 7/2012 |
| DE | 3724087 | A1 | 2/1989 |
| DE | 19706883 | A1 | 9/1998 |
| DE | 102006033825 | A1 | 1/2008 |
| EP | 0455623 | A1 | 11/1991 |
| EP | 1239128 | A1 | 9/2002 |

(Continued)

OTHER PUBLICATIONS

European Search Report for EP Application No. 13183508.4 mailed Feb. 20, 2014 (5 pages).

*Primary Examiner* — Forrest M Phillips
(74) *Attorney, Agent, or Firm* — Merchant & Gould P.C.

(57) ABSTRACT

A muffler shell (1) for use in an exhaust system of a vehicle comprises an inner metal sheet (13) and an outer metal sheet (10). The outer metal sheet (10) is arranged to enclose the inner metal sheet (13). The muffler shell further comprises a vibro-acoustical dampening material (14) sandwiched between the inner metal sheet (13) and the outer metal sheet (10). Both the inner metal sheet (13) and the outer metal sheet (10) are corrugated sheets made of stainless steel having a thickness in the range of 0.15 mm to 0.30 mm. The vibro-acoustical dampening material has a thickness (T) in the range of 4 mm to 8 mm and a density in the range of 130 kg/m$^3$ to 160 kg/m$^3$.

11 Claims, 3 Drawing Sheets

(56) References Cited

U.S. PATENT DOCUMENTS

| | | | | |
|---|---|---|---|---|
| 4,422,525 | A | 12/1983 | Seeger | |
| 5,163,289 | A * | 11/1992 | Bainbridge | 60/274 |
| 5,168,132 | A | 12/1992 | Beidl et al. | |
| 2004/0238276 | A1 * | 12/2004 | Matias et al. | 181/290 |
| 2012/0273300 | A1 | 11/2012 | Jones et al. | |

FOREIGN PATENT DOCUMENTS

| | | |
|---|---|---|
| EP | 2314840 A1 | 4/2011 |
| GB | 937082 | 10/1961 |

* cited by examiner

MUFFLER SHELL FOR USE IN THE EXHAUST SYSTEM OF A VEHICLE

This application claims benefit of Serial No. 13183508.4, filed 9 Sep. 2013 in the European Patent Office and which application is incorporated herein by reference. To the extent appropriate, a claim of priority is made to the above disclosed application.

BACKGROUND

The present invention relates to a muffler shell for use in the exhaust system of a vehicle and to a muffler comprising such muffler shell according to the respective independent claim.

Mufflers are well-known components in exhaust systems of vehicles. Exhaust systems of vehicles typically comprise various components such as a manifold, one or more catalytic converters, a plurality of pipes or pipe sections, and one or more mufflers for dampening or attenuating sound. Typically, the pipes serve for the transportation of the exhaust gas, either in regions where the exhaust gas is very hot (close to the manifold or the catalytic converter) or in regions where the exhaust gas has already cooled down to some extent (in the regions of the mufflers). For a number of engines the diameter of such pipes is typically in the range of 35 mm for (smaller engines) to 70 mm (larger engines), without being limited thereto. Mufflers, on the other hand, have a much larger diameter than pipes—the cross-section of mufflers typically is at least four times larger than the cross-section of the pipes of the related exhaust system, but may be more than ten to twenty times larger than the cross-section of the pipes of the related exhaust system. A typical value for the circumference of mufflers used in a number of cars may be in the range of 400 mm to 1000 mm, without being limited thereto (their circumference may even be larger). As a consequence, the muffler shell contributes substantially to the total weight of the components of the exhaust system when compared to the pipes. Another consequence is that, due to the larger cross-section and the larger circumference of the muffler shell, the muffler shell will vibrate more easily and will therefore radiate unwanted noise, which is not a problem for the pipes having a considerably smaller cross-section and circumference. For various reasons, for example in order to reduce fuel consumption to protect the environment, there is a requirement to reduce the overall weight of the vehicle wherever possible. This requirement also relates to the various components of the exhaust system of the vehicle including the mufflers. On the other hand, mufflers must be corrosion resistant and must have a high durability so as to withstand the various mechanical stresses to which the mufflers are exposed during operation (e.g. vibrations).

Mufflers typically comprise a muffler casing comprising a muffler shell and two end pieces. The two end pieces are connected at both ends to the muffler shell either mechanically, for example by using lock seaming techniques, or by welding them to the muffler shell. In the interior of the muffler casing a number of inner parts are arranged for attenuating sound entering the muffler together with the exhaust gas, so that the level of sound exiting the muffler together with the exhaust gas is substantially lower than the level of sound entering the muffler.

Mufflers having a muffler shell comprising a single metal sheet are known. However, in order to fulfill the various requirements, in particular those mentioned above, these single metal sheet muffler shells typically are made of specific types of steel, and the sheets have a thickness of at least 0.8 mm or more.

Also known are so-called "double skin" mufflers having a muffler shell comprising two metal sheets, an inner metal sheet and an outer metal sheet. Different types of these "double skin" mufflers are known.

A first known type of "double-skin" muffler comprises an inner metal sheet and an outer metal sheet without an insulation material arranged between the inner metal sheet and the outer metal sheet. Both the inner metal sheet and the outer metal sheet are connected to the end piece (end plate), and both metal sheets are carrying the load (weight) of the inner parts of the muffler (the sound dampening parts arranged in the interior of the muffler casing). In this first type of "double-skin" muffler, both the inner metal sheet and the outer metal sheets must be able to carry the load of the inner parts of the muffler and to withstand the mechanical and vibro-acoustical stresses to which the muffler is exposed during operation of the vehicle. In addition, the inner metal sheet must be resistant to the corrosive effects of the exhaust gas while the outer metal sheet must provide for good heat insulation towards the environment, that is to say the outer sheet should not heat up to too high temperatures during operation of the vehicle. Also, the outer metal sheet must be resistant to corrosion caused by environmental substances (e.g. water splashing against the outer metal sheet during operation of the vehicle). For this first type of "double-skin" muffler, typical thicknesses are 0.4 mm to 0.6 mm for each sheet, and the total thickness for both sheets of the "double-skin" is typically in the range of 0.8 mm to 1 mm.

A second known type of "double-skin" muffler comprises an inner metal sheet and an outer metal sheet and an insulation material arranged between the inner metal sheet and the outer metal sheet. The insulation material arranged between the inner metal sheet and the outer metal sheet is intended to reduce the transmission of structure-borne sound from the inner metal sheet to the outer metal sheet so that the structure-borne sound level emitted from the muffler shell is as low as possible. A second purpose of the insulation material is to reduce the transfer of heat from the inner metal sheet, which is heated up by the hot exhaust gas flowing through the muffler, to the outer metal sheet. In this second type of "double-skin" muffler, the inner metal sheet is connected in a leak-tight manner to the end pieces (end plates) of the muffler casing first, and only then the insulation material is mounted. The outer metal sheet can then be connected to the inner metal sheet or to the end pieces (end plate) or to any component of the muffler which is sufficiently rigid to carry the load of the outer metal sheet. However, this connection of the second metal sheet does not have to be leak-tight. In this second type of "double-skin" muffler, only the inner metal sheet must be able to carry the load of the inner parts of the muffler. Also, the inner metal sheet must be able to withstand the mechanical and vibro-acoustical stresses to which the muffler is exposed during operation of the vehicle. In addition, the inner metal sheet must be resistant to the corrosive effects of the exhaust gas. The outer metal sheet must provide for good heat insulation towards the environment, that is to say the outer sheet should not heat up to too high temperatures during operation of the vehicle. Also, the outer metal sheet must be resistant to corrosion caused by environmental substances (e.g. water splashing against the outer metal sheet during operation of the vehicle). However, the outer metal sheet does not have to be able to carry the load of the inner parts of the muffler. For this second type of "double-skin" muffler, a typical thickness of the inner metal sheet is 0.6 mm or more while the outer metal sheet may have a thickness of about 0.2 mm.

Therefore, there is an ongoing need for mufflers and muffler shells having a reduced weight compared with that of prior art mufflers and muffler shells. At the same time, the mufflers and muffler shells must fulfill the afore-mentioned requirements as to corrosion resistance and as to mechanical durability.

SUMMARY

The present invention suggests a muffler shell as it is specified in the independent claim directed to the muffler shell. Additional aspects of embodiments of the muffler shell according to the invention are the subject of the dependent claims directed to the muffler shell. A further aspect of the invention relates to a muffler comprising a muffler shell according to the invention, as specified in the independent claim directed to the muffler.

In particular, in accordance with the invention the muffler shell for use in an exhaust system of a vehicle comprises an inner metal sheet and an outer metal sheet, with the outer metal sheet being arranged to enclose the inner metal sheet. The muffler shell further comprises a vibro-acoustical dampening material sandwiched between the inner metal sheet and the outer metal sheet. Both the inner metal sheet and the outer metal sheet are corrugated sheets made of stainless steel and have a thickness in the range of 0.15 mm to 0.30 mm. The vibro-acoustical dampening material sandwiched between the inner sheet of stainless steel and the outer sheet of stainless steel has a thickness in the range of 4 mm to 8 mm and a density in the range of 130 kg/m$^3$ to 160 kg/m$^3$.

In some embodiments of the muffler shell according to the invention, the thickness of the inner sheet of stainless steel and of the outer sheet of stainless steel is about 0.2 mm.

In some further embodiments of the muffler shell according to the invention, the height of the corrugations of the inner and outer sheets of stainless steel is in the range of 0.7 mm to 1.3 mm.

In still some further embodiments of the muffler shell according to the invention, the corrugation step is in the range of 4 mm to 8 mm.

In yet some further embodiments of the muffler shell according to the invention, the corrugations of the inner sheet of stainless steel and of the outer sheet of stainless steel are running both along the length of the respective sheet of stainless steel as well as along the width of the sheet of stainless steel so as to form dimpled sheets.

In still another embodiment of the muffler shell according to the invention, the vibro-acoustical dampening material is also heat-insulating.

Another aspect of the invention relates to a muffler for use in an exhaust system of a vehicle. The muffler comprises a muffler casing including a muffler shell according to anyone of the above-described embodiments, an inlet end piece and an outlet end piece connected to the muffler shell, as well as inner parts arranged in the interior of the muffler casing for attenuating sound entering the interior of the muffler.

In some embodiments of the muffler according to the invention, the inlet end piece and the outlet end piece are connected to the muffler shell through a mechanical connection.

In some other embodiments of the muffler according to the invention, the inlet end piece and the outlet end piece are connected to the muffler shell through welding.

In yet some further embodiments of the muffler according to the invention, both the inner sheet of the muffler shell and the outer sheet of the muffler shell are rigidly connected to the inlet end piece and to the outlet end piece.

In still some further embodiments of the muffler according to the invention, both the inner sheet of the muffler shell and the outer sheet of the muffler shell are connected to the inlet end piece and to the outlet end piece in a leak-tight manner.

The muffler shell according to the invention is of comparatively low weight due to comprising only two corrugated stainless steel sheets of considerably lower thickness (0.15 mm to 0.30 mm) and a vibro-acoustical dampening material having a thickness in the range of 4 mm to 8 mm and a density in the range of 130 kg/m$^3$ to 160 kg/m$^3$ arranged therebetween. The term "vibro-acoustical dampening material" denotes a material which (for the described thickness range and density range of the material) reduces noise radiated by the muffler shell, in particular in a frequency range below 600 Hz, and more generally improves the vibro-acoustical behavior of the muffler shell. The reduction/improvement is obtained by the effect of increasing the first resonance frequency of the muffler shell by at least 100%, preferably by at least 150%, more preferably by at least 200% and/or by dampening the amplitude of the noise at the first frequency by at least 3 dB, preferably at least 4 dB, more preferably at least 5 dB, when compared to a muffler shell comprising only a single non-corrugated sheet of metal having a thickness corresponding to the added thickness of the two thin sheets of the muffler according to the invention. Contrary to the expectations of those skilled in the art it is possible to use two sheets of stainless steel having such small thickness, however, only the combination of all features (corrugated sheet material, thickness range of the sheets, thickness range and density of the vibro-acoustical dampening material) fulfills the requirements for muffler shells as regards corrosion, structure-borne noise and mechanical durability. Also, the muffler shell according to the invention is capable of carrying load (weight/forces), which is also a result of the combination of all three features (corrugated sheet material, thickness range of the sheets, thickness range and density of the vibro-acoustical dampening material).

Both the inner metal sheet as well as the outer metal sheet of the muffler shell of the muffler (once a muffler has been formed by connecting the muffler shell according to the invention with an inlet and piece and an outlet end piece) carry a portion of the load, since the vibro-acoustical dampening material has a density providing for a relatively stiff connection between the inner metal sheet and the outer metal sheet, so that the vibro-acoustical dampening material can transfer mechanical forces between the inner metal sheet and the outer metal sheet while maintaining the vibro-acoustical dampening effect. Furthermore, both the inner metal sheet and the outer metal sheet are rigidly connected to the end pieces (end plates) of the muffler so that the load is effectively distributed to both metal sheets. In a preferred embodiment, the connection of the outer metal sheet to the end pieces is also leak-tight as a consequence of a maximum contact surface between them, to distribute the load from the inner metal sheet to the outer metal sheet, so that the thickness and weight of both the inner metal sheet and of the outer metal sheet can be minimized. Preferably the muffler casing with the inner metal sheet and the outer metal sheet and the mat in between are manufactured, and only in a second step thereafter the muffler is assembled. For example, a practical thickness of the stainless steel sheets can be about 0.2 mm, the height of the corrugations (from the uppermost point to the lowermost point) can be in the range of 0.7 mm to 1.3 mm, and the corrugation step (distance between two adjacently arranged maxima) can be between 4 mm and 8 mm. The mechanical durability and structure-borne noise is particularly good if the corrugations of the inner sheet of stainless steel and of the outer sheet of stainless steel are "two-dimensional", that is to say the corrugations of the inner sheet of stainless steel and of the outer sheet of stainless steel are running both along the length of the respective sheet of stainless steel as well as along the width of the sheet of stainless steel so as to form dimpled sheets. However, the corrugations may also be "one-dimensional", that is to say they run in one direction only. In particular, it may then be advantageous if the corrugations of the inner sheet of stainless steel and the outer sheet of stainless steel run in different directions so that the directions of the corrugations of the inner sheet and outer sheet of stainless steel include an angle which, for example, may be in the range of 60 degrees to 90 degrees. The corrugations of the metal sheets add stiffness to the sheets and enhance the contact with the sandwiched vibro-acoustical dampening material, for example to increase the shear forces in order to maximize transfer of load between all three layers (the inner metal sheet, the outer metal sheet and the sandwiched vibro-acoustical dampening material).

A muffler comprising such muffler shell is particularly advantageous since it is of comparatively low weight. The inlet end piece and the outlet end piece (often also called "end caps") can be connected to the muffler shell either through a mechanical connection, e.g. through lock seaming, or alternatively the inlet end piece and the outlet end piece are connected to the muffler shell through a weld.

BRIEF DESCRIPTION OF THE DRAWINGS

Further advantageous aspects become apparent from the following description of embodiments of the muffler casing and the muffler according to the invention with the aid of the drawings in which.

DETAILED DESCRIPTION

Figure 1:
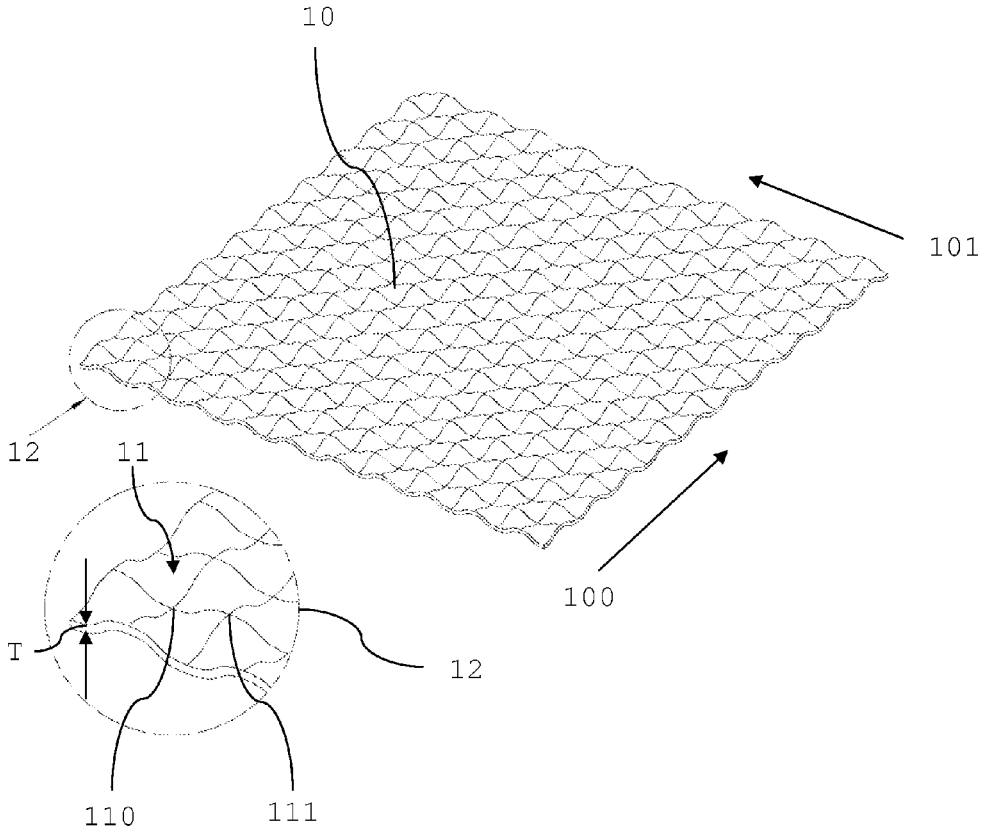
FIG. 1 shows an embodiment of a corrugated sheet of the muffler shell according to the invention, together with an enlarged detail thereof.

FIG. 1 shows an embodiment of a corrugated sheet 10 of a muffler shell according to the invention. As can be seen, the sheet is corrugated both along the length of the sheet as well as along the width of the sheet, as this is indicated by the arrows 100 and 101, respectively. As a result corrugated sheet 10 comprises a plurality of dimples 11 which can be seen best in the enlarged detail 12, with a plurality of minima 110 being arranged between a plurality of maxima 111. Minima 110 are arranged wherever the minima of the two corrugations (along the length and along the width of the sheet) meet, and maxima 111 are arranged wherever the maxima of the two corrugations (along the length and along the width of the sheet) meet. The corrugated sheet 10 (as well as the corrugated sheet 13, see FIG. 3) is made of stainless steel and has a thickness T in the range of 0.15 mm to 0.30 mm, and in particular has a thickness T of about 0.2 mm. The corrugations in one direction (i.e. along the length or the width) preferably have a corrugation height H (measured from the uppermost point to the lowermost point, see detail 15 in FIG. 2) which is in the range of 0.7 mm to 1.3 mm, and the corrugation step S (the distance measured between two adjacent uppermost points or between two adjacent lowermost points of the corrugations in one direction, i.e. along the length or the width, see detail 15 in FIG. 2) preferably is in the range of 4 mm to 8 mm. For example, a stainless steel sheet material that can be used for the muffler casing is "Steel EN 10088-2 1.4541".

Figure 2:
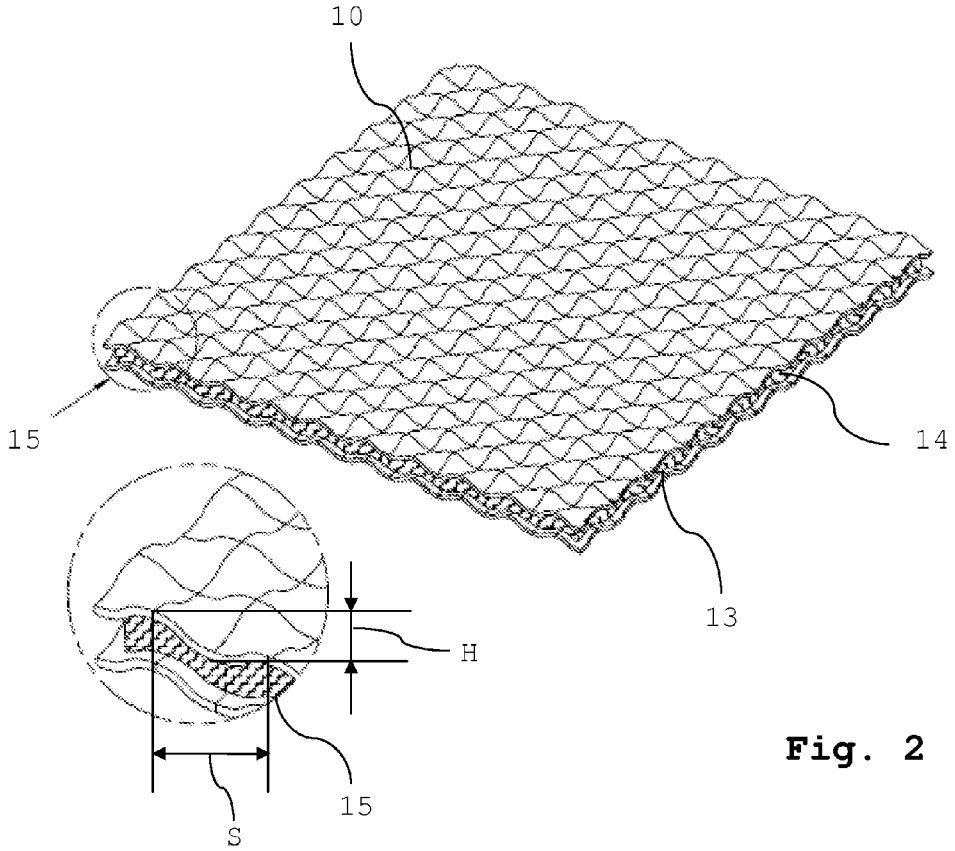
FIG. 2 shows two flat corrugated sheets of the muffler shell according to the invention with a vibro-acoustical dampening material sandwiched therebetween.

FIG. 2 shows a sheet material having two flat corrugated sheets, an upper sheet 10 and a lower sheet 13 of the muffler shell according to the invention, with a vibro-acoustical dampening material 14 sandwiched between upper corrugated sheet 10 and lower corrugated sheet 13. Additionally, the vibro-acoustical dampening material may also be heat-insulating. Both the upper corrugated sheet 10 and the lower corrugated sheet 13 have a thickness in the range of 0.15 mm to 0.30 mm and are made of stainless steel. In particular, both the upper corrugated sheet 10 and the lower corrugated sheet 13 have a thickness T of about 0.2 mm and are made of stainless steel. Preferably, the vibro-acoustical dampening material 14 on one hand must be able to transmit mechanical forces from the lower corrugated sheet 13 to the upper corrugated sheet 10 and vice versa (depending on which of the sheets finally is the inner metal sheet and which is the outer metal sheet) while on the other hand it must be able to attenuate structure-borne sound. Thus, structure-borne sound is prevented or at least greatly reduced from being transmitted from the inner sheet of the muffler shell to the outer sheet of the muffler shell, as will be explained further below. Heat-insulating in particular relates to the ability of the sandwiched material 14 to prevent or at least greatly reduce the transfer of heat from the inner sheet of the muffler shell to the outer sheet of the muffler shell. The sandwiched material 14 has a thickness in the range of 4 mm to 8 mm and has a density in the range of 130 kg/m$^3$ to 160 kg/m$^3$. A typical vibro-acoustical dampening material is "Powermat" (available from DBW Advanced Fiber Technologies GmbH, Rodetal 40, 37120 Bovenden, Germany) or "Needle mat CE" (available from NBT Automotive, Ul. Przytulna 2, PL66-004 Drzonkow, Poland).

Figure 3:
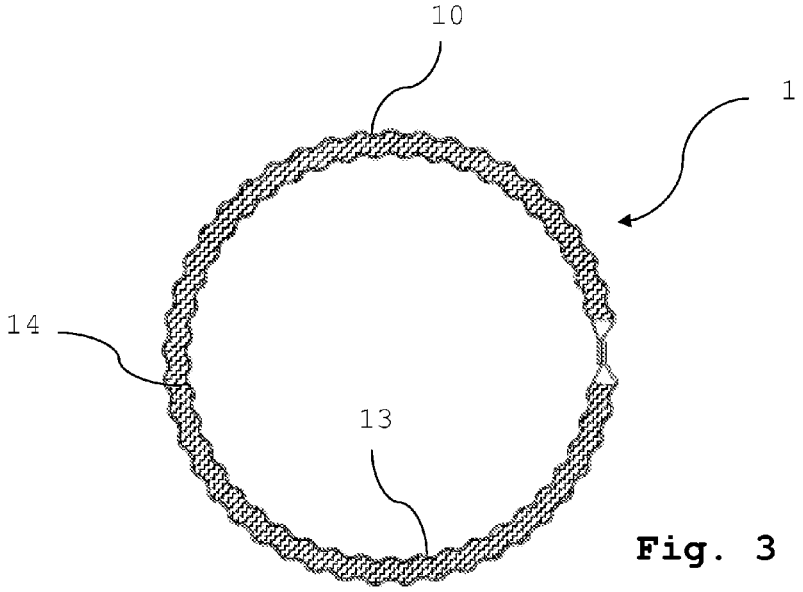
FIG. 3 shows a cross-section of an embodiment of the muffler shell according to the invention, formed from the flat sheet material of FIG. 2.

FIG. 3 shows a cross-section of an embodiment of the muffler shell 1 according to the invention, formed from one or more corrugated sheet materials as shown in FIG. 2, but now having the shape of a muffler shell (without end pieces, or inlet and outlet pieces). Since there are a number of constructional options how such muffler shell can be formed (for example, an upper half shell and a lower half shell each formed from a separate sheet material as shown in FIG. 2 can be connected mechanically or through welding to form the muffler shell; or only a single sheet material as shown in FIG. 2 can be formed to have the shape of the muffler shell shown in FIG. 3 and the ends of that sheet material facing each other can be connected mechanically or through welding, just to name a few), the cross-sectional view does not show the particular way how the muffler shell is formed, since this is not a crucial point. Rather, as can be seen in FIG. 3, the muffler shell 1 comprises an inner sheet of stainless steel which may correspond to the lower sheet 13 of the sheet material shown in FIG. 2 (or to the upper sheet 10, respectively) and an outer sheet of stainless steel which may correspond to the upper sheet 10 of the sheet material shown in FIG. 2 (or to the lower sheet 13, respectively). Typically, the muffler shell is then equipped with two end pieces, an inlet end piece 22 and an outlet end piece 23 (see FIG. 4) to form the muffler casing. As can be seen again from FIG. 3, the vibro-acoustical dampening material 14 is sandwiched between the inner sheet 13 and the outer sheet 10.

Figure 4:
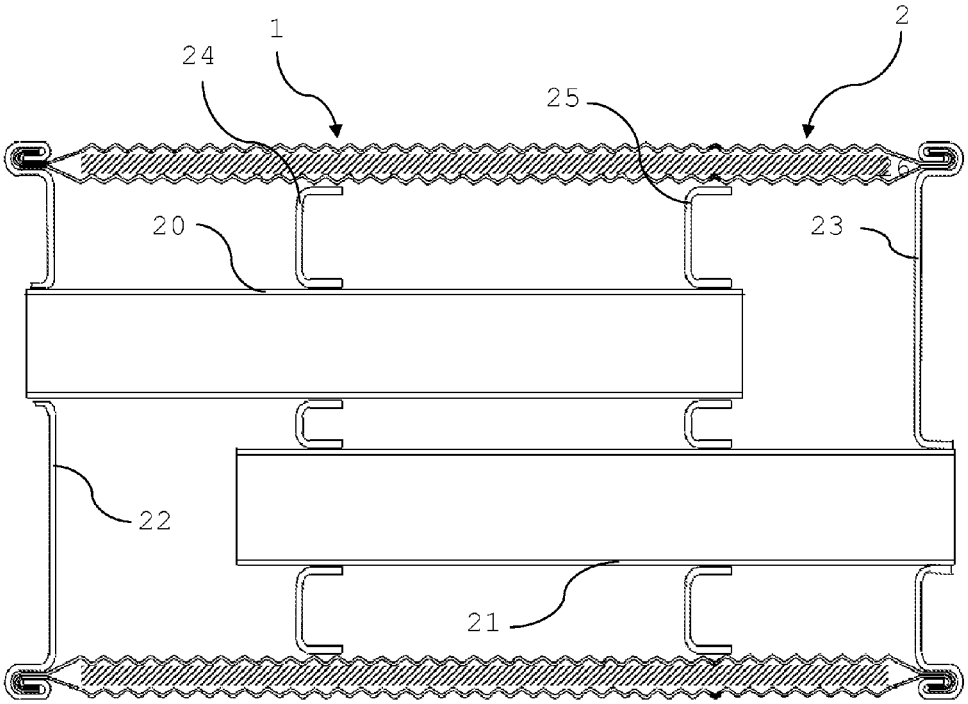
FIG. 4 shows an embodiment of the muffler according to the invention, comprising the muffler shell of FIG. 3 and inner parts arranged in the interior of the muffler shell for attenuating sound.

FIG. 4 shows an embodiment of the muffler 2 according to the invention, comprising the muffler shell 1 of FIG. 3 together with some inner parts arranged in the interior of the muffler shell 1. As can be seen, the muffler 2 comprises an inlet tube 20 and an outlet tube 21 arranged in the interior of the muffler shell 1, as well as an inlet end piece 22 and an outlet end piece 23 connected to the muffler shell 1 at the inlet end and the outlet end, respectively. In addition, the muffler 2 comprises two mounting elements 24, arranged in the interior of the muffler shell 1 for mounting both the inlet tube 20 and the outlet tube 21. The mounting elements can be disk-like members (baffles) which have larger diameter holes for accommodating the inlet tube 20 and the outlet tube 21, as well as smaller diameter holes (not shown) to allow exhaust gas entering the muffler through the inlet tube and exiting the outlet of inlet tube 21 to subsequently flow through the interior of the muffler 2 back to the inlet of outlet tube 21 and finally out of the muffler 2. During the flow of the exhaust gas through the interior of the muffler, sound contained in and transported by the exhaust gas is attenuated to reduce the level of sound emitted from the outlet tube 21 of the muffler 2, as this is well-known in the art. Mounting elements (baffles) 24 and 25 can be fixed to the inner sheet 13 of the muffler shell 1 through clamping or any other suitable technique known in the art for that purpose. Since the outer and inner sheets of this embodiment of the muffler 2 according to the invention are made of stainless steel having a thickness of about 0.2 mm only, the overall weight of the muffler is greatly reduced compared with mufflers presently available. At the same time, the muffler 2 according to the invention fulfills the requirements regarding corrosion resistance, mechanical durability, absorbance of structure-borne sound and thermal transfer to the outer sheet (in case the vibro-acoustical dampening material is also heat-insulating), and capability of carrying load.

Figure 5:
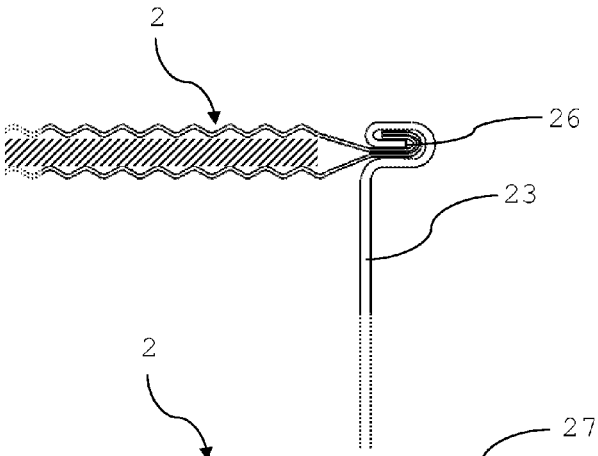
FIG. 5 shows an embodiment of a mechanical connection (performed by lock seaming) of an outlet piece to the muffler shell shown in FIG. 3.
Figure 6:
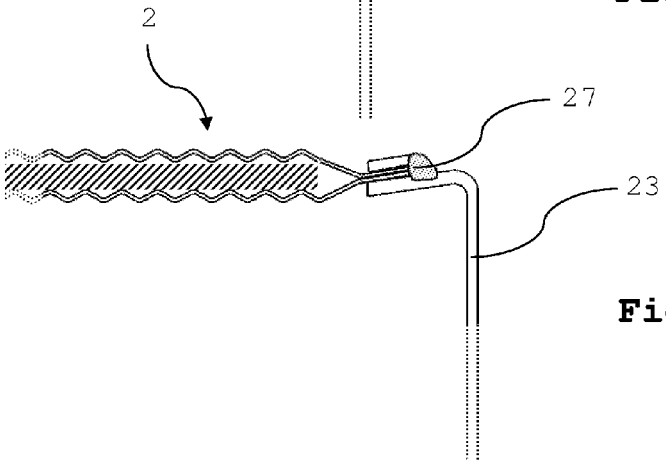
FIG. 6 shows an embodiment of a connection of the outlet piece to the muffler shell shown in FIG. 3 (performed by welding).

FIG. 5 and FIG. 6 show embodiments of a connection of the outlet end piece (and, of course, also the inlet end piece, although not shown) to the muffler shell 1. According to FIG. 5 the connection of the outlet end piece 23 to the muffler shell 1 is a mechanical connection 26 (in the instant case this mechanical connection has been formed through lock seaming). According to FIG. 6 the connection of the outlet end piece 23 to the muffler shell 1 is a connection comprising a weld 27 meaning that the outlet end piece has been welded to the muffler shell. Both techniques are known in the art as being reliable techniques for connecting the end pieces to the muffler shell. At the connection location, the corrugations may be flattened either before or during forming the connection.

While embodiments of the muffler shell and the muffler have been explained with the aid of the drawings, it is evident that many changes and modifications are possible without departing from the teaching of the present invention. Therefore, scope of protection is not limited to the embodiment but rather is defined by the appended claims.

The invention claimed is:

1. Muffler shell for use in an exhaust system of a vehicle, the muffler shell comprising an inner metal sheet and an outer metal sheet, with the outer metal sheet being arranged to enclose the inner metal sheet, and further comprising a vibro-acoustical dampening material sandwiched between the inner metal sheet and the outer metal sheet, wherein both the inner metal sheet and the outer metal sheet are corrugated sheets made of stainless steel having a thickness in the range of 0.15 mm to 0.30 mm, and wherein the vibro-acoustical dampening material sandwiched between the inner sheet of stainless steel and the outer sheet of stainless steel has a thickness in the range of 4 mm to 8 mm and a density in the range of 130 $kg/m^3$ to 160 $kg/m^3$.

2. The muffler shell according to claim 1, wherein the thickness of the inner sheet of stainless steel and of the outer sheet of stainless steel is about 0.2 mm.

3. The muffler shell according to claim 1, wherein the height of the corrugations of the inner and outer sheets of stainless steel is in the range of 0.7 mm to 1.3 mm.

4. The muffler shell according to claim 1, wherein the corrugation step is in the range of 4 mm to 8 mm.

5. The muffler shell according to claim 1, wherein the corrugations of the inner sheet of stainless steel and of the outer sheet of stainless steel are running both along the length of the respective sheet of stainless steel as well as along the width of the sheet of stainless steel so as to form dimpled sheets.

6. The muffler shell according to claim 1, wherein the vibro-acoustical dampening material is also heat-insulating.

7. The muffler for use in an exhaust system of a vehicle, comprising a muffler casing including a muffler shell according to claim 1, an inlet end piece and an outlet end piece connected to the muffler shell, as well as inner parts arranged in the interior of the muffler casing for attenuating sound entering the interior of the muffler.

8. The muffler according to claim 7, wherein the inlet end piece and the outlet end piece are connected to the muffler shell through a mechanical connection.

9. The muffler according to claim 8, wherein the inlet end piece and the outlet end piece are connected to the muffler shell through a weld.

10. The muffler according to claim 7, wherein both the inner sheet of the muffler shell and the outer sheet of the muffler shell are rigidly connected to the inlet end piece and to the outlet end piece.

11. The muffler according to claim 7, wherein both the inner sheet of the muffler shell and the outer sheet of the muffler shell are connected to the inlet end piece and to the outlet end piece in a leak-tight manner.

* * * * *